US005617795A

United States Patent [19]

Glomski et al.

[11] Patent Number: 5,617,795

[45] Date of Patent: Apr. 8, 1997

[54] TIE GUIDE AND PLATE HOLDING APPARATUS

[75] Inventors: Krzysztof E. Glomski; Kurt L. Natterstad; Thomas H. Hoover, all of Fairmont, Minn.

[73] Assignee: Harsco Corporation, Camp Hill, Pa.

[21] Appl. No.: 305,901

[22] Filed: Sep. 14, 1994

[51] Int. Cl.[6] ..... E01B 29/06

[52] U.S. Cl. ..... 104/9

[58] Field of Search ..... 104/9, 2, 16, 7.1; 198/836.1, 779

[56] References Cited

U.S. PATENT DOCUMENTS

| | | | |
|---|---|---|---|
| 3,240,162 | 3/1966 | Foxx | 104/9 |
| 3,314,374 | 4/1967 | Moorehead et al. | 104/9 |
| 3,675,580 | 7/1972 | Kershaw | 104/9 |
| 4,018,165 | 4/1977 | Bryan | 104/9 |
| 4,241,663 | 12/1980 | Lund et al. | 104/16 |
| 4,951,573 | 8/1990 | Madison | 104/9 |
| 5,048,424 | 9/1991 | Madison et al. | 104/9 |
| 5,197,389 | 3/1993 | Glomski et al. | 104/9 |
| 5,305,692 | 4/1994 | Madison et al. | 104/9 |
| 5,314,059 | 5/1994 | Clopton | 198/836.1 |

*Primary Examiner*—S. Joseph Morano

*Attorney, Agent, or Firm*—Eckert Seamans Cherin & Mellott

[57] ABSTRACT

An apparatus grips tie plates and guides new ties during replacement of worn out ties in the road bed of a railroad track. Mechanical grip elements grip tie plates and secure them against the rail, while an old tie is removed and a new tie is inserted. A spring arrangement automatically self-centers opposing pairs of grip elements. That is, when beginning to grip a tie plate, each pair of mechanical grip elements will automatically center about the tie plate prior to securely gripping the tie plate and without moving the tie plate. The grip elements are supported by an apparatus frame. A frame lifter moves the apparatus frame vertically between an upper and a lower position relative to a vehicle frame of a tie replacer vehicle. A tie guide includes rollers on the underside thereof for minimizing friction between ties being inserted and the tie guide. Sweepers are mounted to the apparatus frame to clean off a tie as it is being inserted.

13 Claims, 4 Drawing Sheets

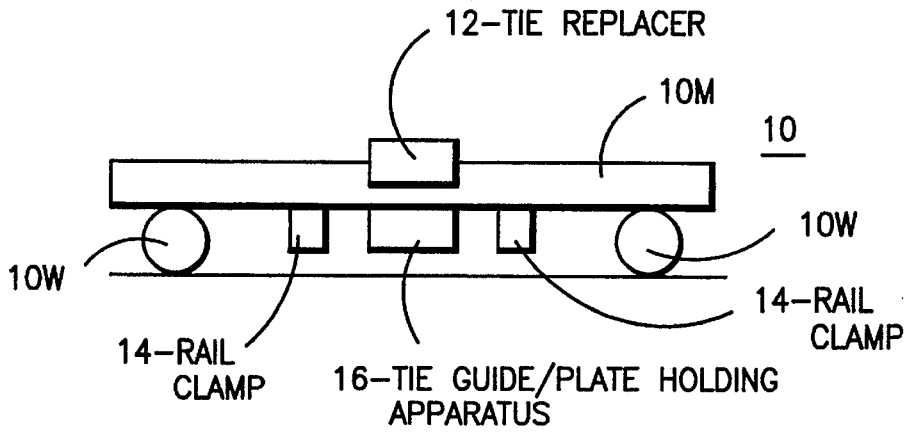
FIG. 1
FIG. 4
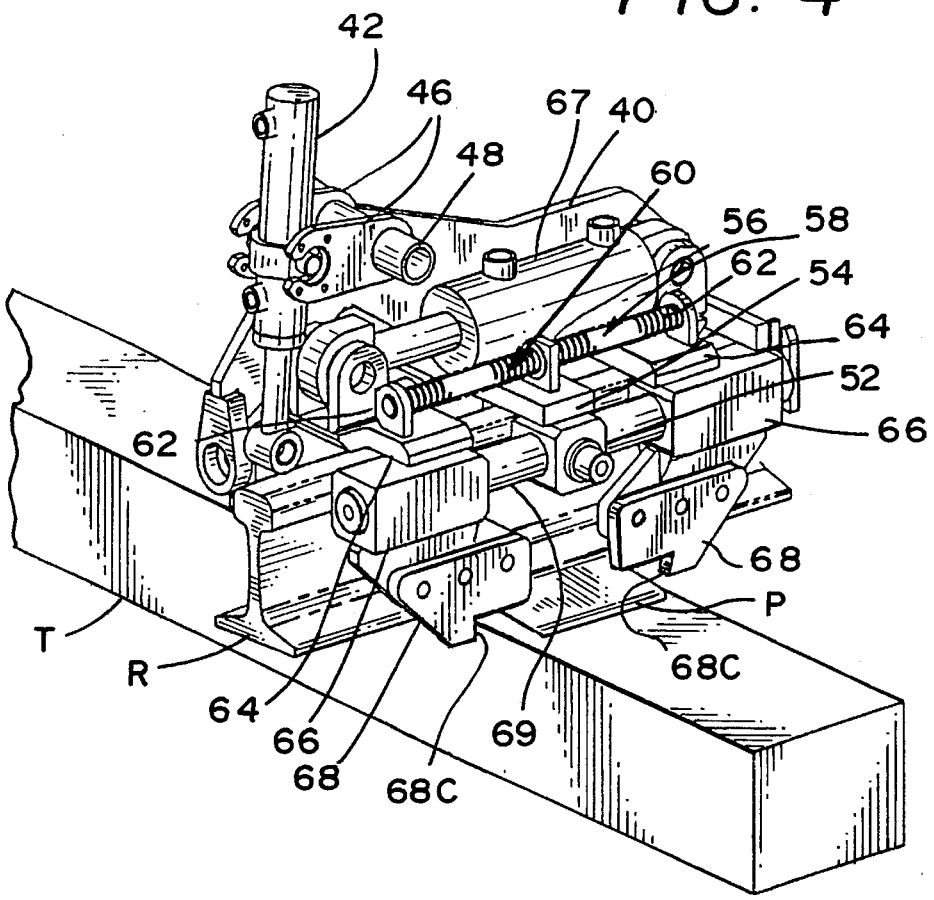

TIE GUIDE AND PLATE HOLDING APPARATUS

BACKGROUND OF THE INVENTION

This invention relates to an apparatus for assisting in maintenance of rail roadbeds. More specifically, it relates to an apparatus for guiding new ties into the roadbed and for holding tie plates against rails when ties are being replaced.

In order to maintain railroad tracks in safe operating condition, it is necessary to replace the ties periodically. The ties (made of wood, metal or concrete) underneath the rails tend to wear out after an extended period of use. Various machines have been developed for removing and/or inserting the ties.

Among problems encountered in use of such machines are the handling of the tie plates when old ties are removed. Manual handling of the tie plates slows down the process and increases costs and safety risks. Absent intervention, the tie plates simply drop to the roadbed when the old ties are removed.

Another problem is getting a new tie to slide into the cavity left by removal of the old tie without catching on the rails (which rails are lifted during removal and insertion), any tie plates held against the rails, and other obstructions.

The following U.S. patents, assigned to the assignee of the present application and hereby incorporated by reference, show various such machines:

| U.S. Pat. No. | Inventor | Issue Date |
|---|---|---|
| 4,951,573 | Madison | August 28, 1990 |
| 5,048,424 | Madison et al | September 17, 1991 |
| 5,197,389 | Glomski et al | March 30, 1993 |

Madison '573 discloses a tie remover/inserter using the structure of a modified backhoe.

Madison and Newman '424 discloses a tie replacer including a tie guide structure to help guide the new tie into proper position without catching on obstructions. It uses electromagnets to hold tie plates against the uplifted rails.

Glomski, Newman, and Madison '389 discloses a tie replacer with a tie guide assembly and air-cylinder operated magnets to hold the tie plates against the rails.

U.S. Pat. No. 4,241,663 issued Dec. 30, 1980 to Lund et al. discloses use of electromagnets to hold tie plates to rails.

Although those and various other devices for tie plate handling and/or tie guiding have been generally useful, they have been subject to one or more disadvantages.

Those devices using magnets or electromagnets for holding tie plates often pick up metal parts (such as loose tie plate spikes) other than tie plates. Such other metal parts may prevent the devices from securely holding the tie plates against the rails. Further, even non-metallic debris, such as ballast, may get between the tie plates and the magnets or electromagnets and cause tie plates to drop free of the rails.

The guide assemblies or structures for guiding ties into place often still have problems with debris blocking ties as they go into place. Further, it often requires great force to overcome friction and to get the ties into place using such tie guides. Finally, such tie guides often allow or cause wandering of the tie as it is inserted. In other words, the tie doesn't maintain its orientation perpendicular to the rails during insertion.

OBJECTS AND SUMMARY OF THE INVENTION

Accordingly, it is a primary object of the present invention to provide a new and improved tie guide and tie plate holding assembly.

A more specific object of the present invention is to provide a tie guide which eases insertion of ties and reduces the amount of force required to insert a new tie.

A further object of the present invention is to provide a tie plate holder which avoids or minimizes problems from debris.

Yet another object of the present invention is to provide a tie plate holder and tie guide which are highly efficient and reliable.

The above and other features of the present invention which will be more readily understood when the following detailed description is considered in conjunction with the accompanying drawings are realized by an apparatus for aiding in tie replacement operations including: a frame; and first and second side clamp assemblies supported by the frame. Each of the first and second clamp assemblies have a pair of opposing field side mechanical grip elements and a pair of opposing gauge side mechanical grip elements, the pairs of field side and gauge side mechanical grip elements operable to grip tie plates when ties thereunder are removed and replaced. The pairs of field side and gauge side mechanical grip elements are self-centering such that when gripping a tie plate each pair of mechanical grip elements will automatically center about the tie plate prior to gripping the tie plate and without moving the tie plate. The first and second clamp assemblies further include respective corresponding first and second grip hydraulic cylinders. Each pair of mechanical grip elements are attached for movement with opposing rod and cylinder ends of one of the first and second hydraulic cylinders.

Each of the first and second clamp assemblies further include at least one spring corresponding to each hydraulic cylinder and operably connected to the corresponding mechanical grips for self-centering thereof. More preferably, each of the first and second clamp assemblies further includes two springs corresponding to each hydraulic cylinder and operably connected to the corresponding mechanical grips for self-centering thereof.

The frame is an apparatus frame with at least a first frame lifter connected to the apparatus frame for moving the apparatus frame between upper and lower frame positions relative to a vehicle main frame. There are first and second clamp assembly lifters for vertically moving the respective first and second clamp assembly lifters relative to the apparatus frame.

The apparatus further includes a tie guide supported by the frame, the tie guide having a plurality of rollers on an underside thereof, the rollers operable to minimize friction between the tie guide and a new tie being inserted under the tie guide. A first sweeper supported by the apparatus frame and positioned to sweep debris off the top of ties being inserted.

The apparatus is combined with a tie replacer vehicle.

The present invention may alternately be described as an apparatus for aiding in tie replacement operations including: a apparatus frame with at least a first frame lifter connected to the apparatus frame for moving the apparatus frame between upper and lower frame positions relative to a vehicle main frame; and a first side clamp assembly supported by the apparatus frame and having mechanical grip elements operable to grip tie plates when ties thereunder (i.e., under the first side clamp assembly) are removed and replaced. The first side clamp assembly includes a pair of opposing field side mechanical grip elements and a pair of opposing gauge side mechanical grip elements, the pairs of field side and gauge side mechanical grip elements operable to grip tie plates when ties thereunder are removed and replaced.

The apparatus further includes a second side clamp assembly supported by the apparatus frame and having mechanical grip elements operable to grip tie plates when ties thereunder are removed and replaced, and wherein the second side clamp assembly includes a pair of opposing field side mechanical grip elements and a pair of opposing gauge side mechanical grip elements, the pairs of field side and gauge side mechanical grip elements operable to grip tie plates when ties thereunder are removed and replaced. The mechanical grip elements include a pair of self-centering mechanical grip elements such that when gripping a tie plate the pair of mechanical grip elements will automatically center about the tie plate prior to gripping the tie plate and without moving the tie plate. The first side clamp assembly further includes at least one spring operably connected to self-center the pair of mechanical grip elements. More specifically, the mechanical grip elements are pairs of self-centering field side and gauge side mechanical grip elements such that when gripping a tie plate each pair of mechanical grip elements will automatically center about the tie plate prior to gripping the tie plate and without moving the tie plate.

A second side clamp assembly is supported by the apparatus frame on a side opposite the first side clamp assembly and has mechanical grip elements operable to grip tie plates when ties thereunder are removed and replaced.

A tie guide is supported by the apparatus frame, the tie guide having a plurality of rollers on an underside thereof, the rollers operable to minimize friction between the tie guide and a new tie being inserted under the tie guide. A first sweeper is supported by the apparatus frame and positioned to sweep debris off the top of ties being inserted.

The present invention may alternately be described as an apparatus for aiding in tie replacement operations including: an apparatus frame with at least a first frame lifter connected to the apparatus frame for moving the apparatus frame between upper and lower frame positions relative to a vehicle main frame; and a tie guide supported by the apparatus frame, the tie guide having a plurality of rollers on an underside thereof, the rollers operable to minimize friction between the tie guide and a new tie being inserted under the tie guide. A tie guide lifter operably connects the tie guide to the apparatus frame for causing relative vertical movement therebetween. A first side clamp assembly supported by the apparatus frame and having mechanical grip elements operable to grip tie plates when ties thereunder are removed and replaced.

The present invention may alternately be described as an apparatus for aiding in tie replacement operations including: an apparatus frame with at least a first frame lifter connected to the apparatus frame for moving the apparatus frame between upper and lower frame positions relative to a vehicle main frame; a tie guide supported by the apparatus frame; a first side tie plate holder supported by the apparatus frame and operable to grip tie plates when ties thereunder are removed and replaced; and a first sweeper supported by the apparatus frame and positioned to sweep debris off the top of ties being inserted. A second sweeper is supported by the apparatus frame and positioned to sweep debris off the top of ties being inserted. A tie guide lifter operably connects the tie guide to the apparatus frame for causing relative vertical movement therebetween. The tie plate holder includes a first side clamp assembly supported by the apparatus frame and having mechanical grip elements operable to grip tie plates when ties thereunder are removed and replaced.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 1 shows a schematic side view of a vehicle according to the present invention;

FIG. 4 shows a perspective view, with some parts removed for ease of illustration, of a portion of the apparatus;

DETAILED DESCRIPTION

Figure 2:
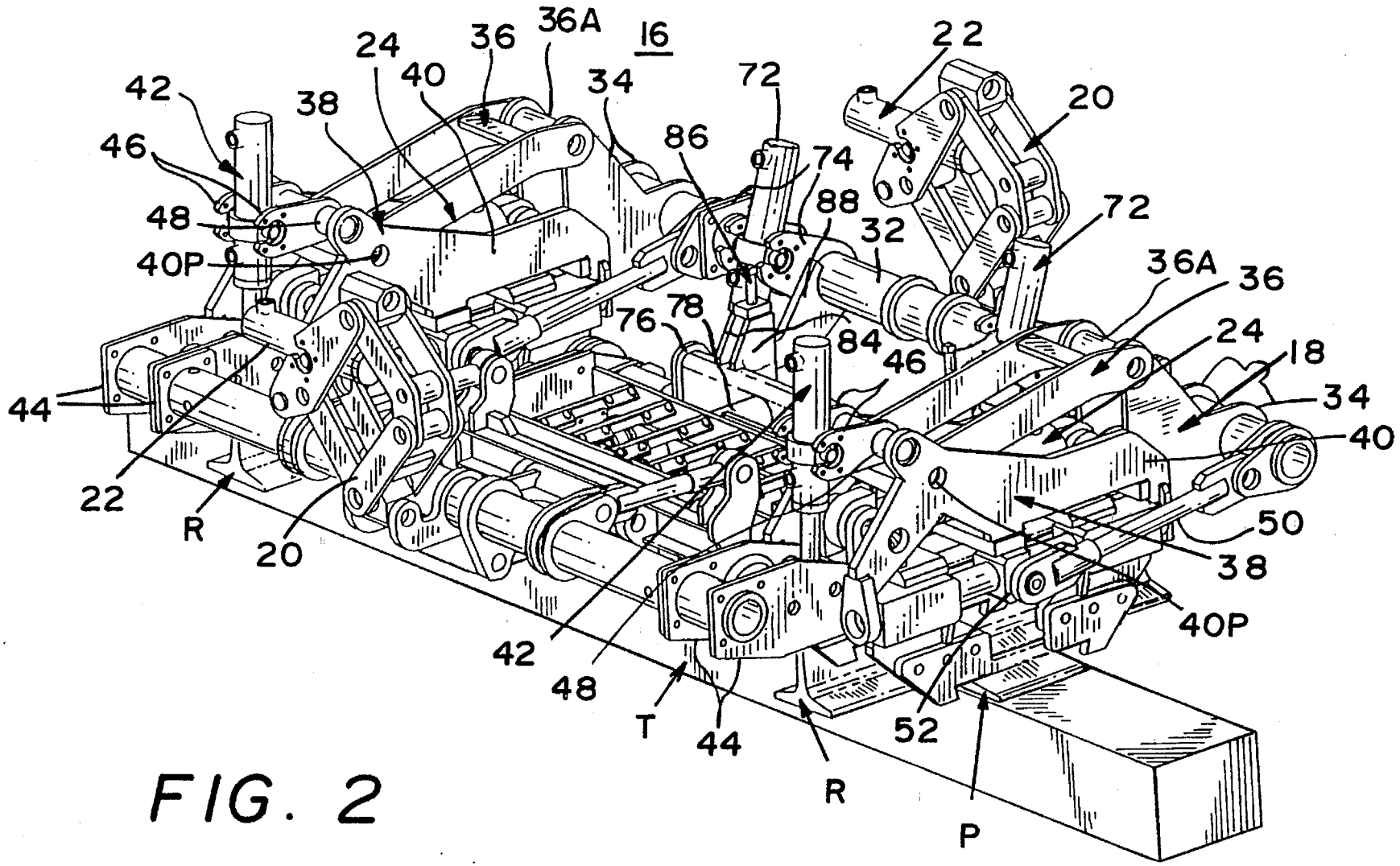
FIG. 2 shows a perspective view of an apparatus for aiding in tie replacement operations according to the present invention.

With reference initially to FIG. 1, a tie replacing vehicle 10 has a main frame 10M and front and back pairs of rail engagement wheels 10W (only one of each pair visible). A tie replacer apparatus 12 is depicted schematically, as are rail clamps 14 and a tie guide/plate holding apparatus 16.

The vehicle 10, tie replacer 12, rail clamps 14, and various other (unshown) parts of the vehicle may be constructed in the fashion shown and described in the above mentioned and incorporated by reference U.S. Patents Madison et. al '424 and/or Glomski et. al '389. However, the tie guide/plate holder 16 is constructed differently from arrangements of those patents and will be discussed in detail below.

Figure 3:
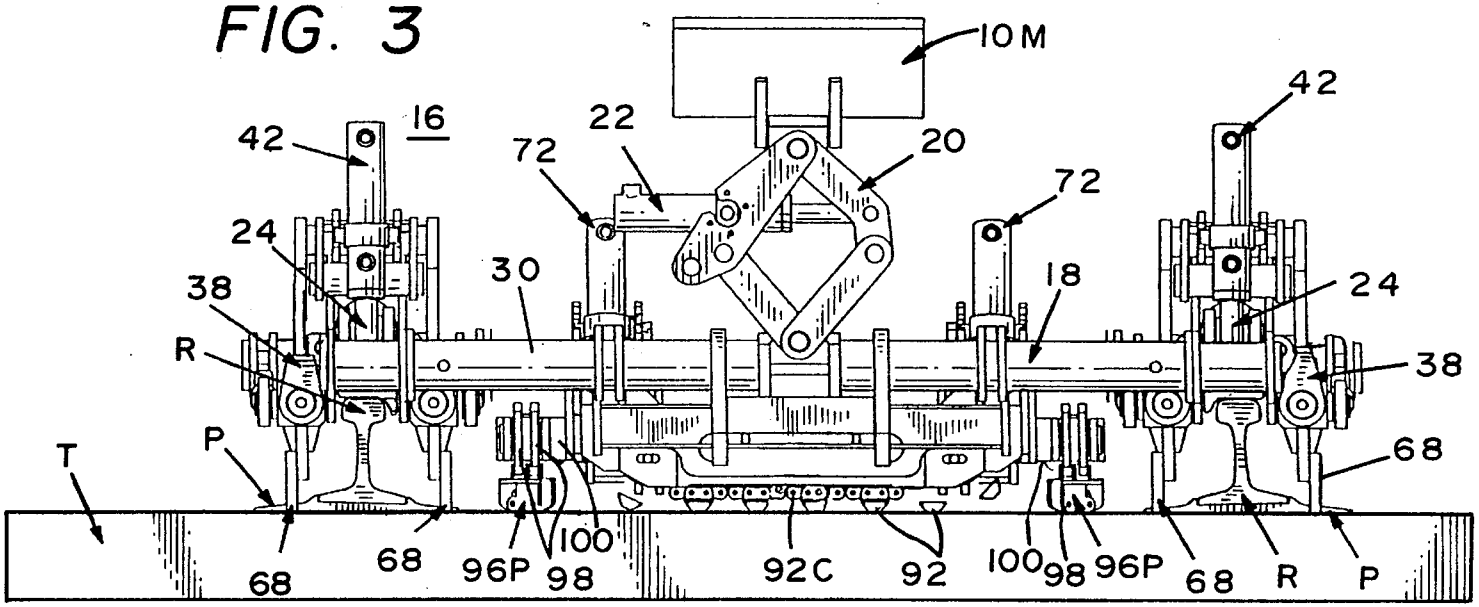
FIG. 3 shows an end view of the apparatus of FIG. 2.

Turning now to FIGS. 2 and 3, the tie guide/plate holder 16 is an apparatus for assisting in the replacement of ties. This guide/holder apparatus 16 serves to hold tie plates P against rails R when an old tie T is being removed and a new tie (not shown) is being inserted. The vehicle 10 will lift the rails R to allow removal of the old tie T and its replacement by a new tie in the manner discussed in Madison '424 and Glomski '389. In addition to holding the tie plates P against the rails R during the tie removal and insertion process, apparatus 16 will guide a new tie in place without it binding against the rails R or other possible obstacles.

The apparatus 16 includes an apparatus frame 18 attached to main or vehicle frame 10M (FIG. 3 only) by front and back scissor linkages 20. The linkages 20 are controlled by hydraulic cylinders 22 which extend to lift apparatus frame 18 into an upper, inoperative or travel position relative to vehicle frame 10M and retract to extend linkages 20 and lower apparatus frame 18 into a lower, operative or working position relative to vehicle frame 10M. Linkages 20 and cylinders 22 together serve as a frame lifter for vertically moving apparatus frame 18.

When lowered into its illustrated working position, apparatus frame 18 has front and back pair of flanged wheels 24 (not all 4 are visible) in contact with the rails R. The apparatus frame 18 has plates 26 and 28 (momentarily view FIG. 5) which are fixed respectively to members 30 and 32 of frame 18.

As best shown in FIG. 2, frame 18 includes right and left pairs of plates 34 to which links 36 are pivotably attached at axles 36A. Plate clamp assemblies 38 have plates 40 pivotably attached at points 40P to ends of the links 36. Hydraulic actuators or cylinders 42 have rod ends secured to plates 44, which are part of apparatus frame 18. The barrel or cylinder ends of actuators 42 are pivotably attached to plates 46 which in turn are mounted to shafts 48. (As will be apparent, the apparatus 16 is symmetric with respect to its right and left sides corresponding to the rails R.) Right and left actuators 42 extend to lift corresponding right and left assemblies 38 by lifting shafts 48 and plates 40 with pivoting at points 40P and axles 36A. Retracting an actuator 42 would lower the corresponding assembly 38 including plates 40 and other parts discussed below.

When lifted into their upper positions, the assemblies 38 are raised such that the vehicle may be indexed or moved until the assemblies 38 are over a tie to be replaced. Assemblies 38 may then be lowered into an operative position for plate clamping as will be discussed. Links 50 (only one visible, right side of FIG. 2, but there is right field side, right gauge side, left field side, and left gauge side of these links) connect to blocks 52 (only one visible, would be right and left side such blocks). The blocks 52 are fixed to corresponding plates 40 and are part of the assemblies 38. The links 50 maintain the proper orientation for assemblies 38 as they are lifted and lowered, links 50, links 36, plates 18, and portions of assemblies 38 collectively constituting a four bar linkages.

Continuing to view FIG. 2, but also referring to FIG. 4, the details of the plate clamp assembly 38 will be discussed. For ease of illustration, the field one of the plates 40 is removed from FIG. 4. It should be appreciated that, not only is there identical right and left side of the plate holding assemblies or holders 38, but the field and gauge side of holding assemblies 38 are identical.

Above the field block 52 (FIG. 4) is a center plate 54 connecting it to a corresponding, not visible, gauge block, all of which are fixed to plates 40. The center plate 54 has a mount 56 to which shaft 58 is fixed with springs 60 movably capturing mounts 62 at opposite ends thereof. The mounts 62 are trapped by lock nuts or rings (not shown) at ends of shaft 58 such that shaft 58 does not slip out of the holes in mounts 62. Mounts 62 are part of end plates 64 which, like center plate 54, extend between identical field and gauge components. End plates 64 have blocks 66 fixed to them and are retracted/extended by operation of jaw cylinder 67. Blocks 66, captured to slide on shaft 69, in turn have jaws or grip elements 68 secured to them. It will therefore be readily appreciated that the grip elements 68 are attached or mounted for sliding movement in a straight line corresponding to movement along shaft 69, which direction of movement is parallel to an extension/retraction direction for the hydraulic cylinder 67. The jaws 68 have contact surfaces 68C which are inclined from vertical. Specifically, in the view of FIG. 4, the right contact surface 68C would be inclined rightwardly at its upper end and left contact surface 68C would be inclined leftwardly at its upper end. In that fashion, opposing jaws 68 may firmly wedge tie plate P against the rail R. The jaws 68 of FIG. 4 are the field jaws on one side of the track, it being understood that identical gauge jaws would hold the gauge side of the plate P and that identical field and gauge side jaws would be mounted on the other side of the vehicle. There would be 4 jaws 68 associated with each rail R for a total of 8 jaws 68 on the apparatus 16.

Figure 5:
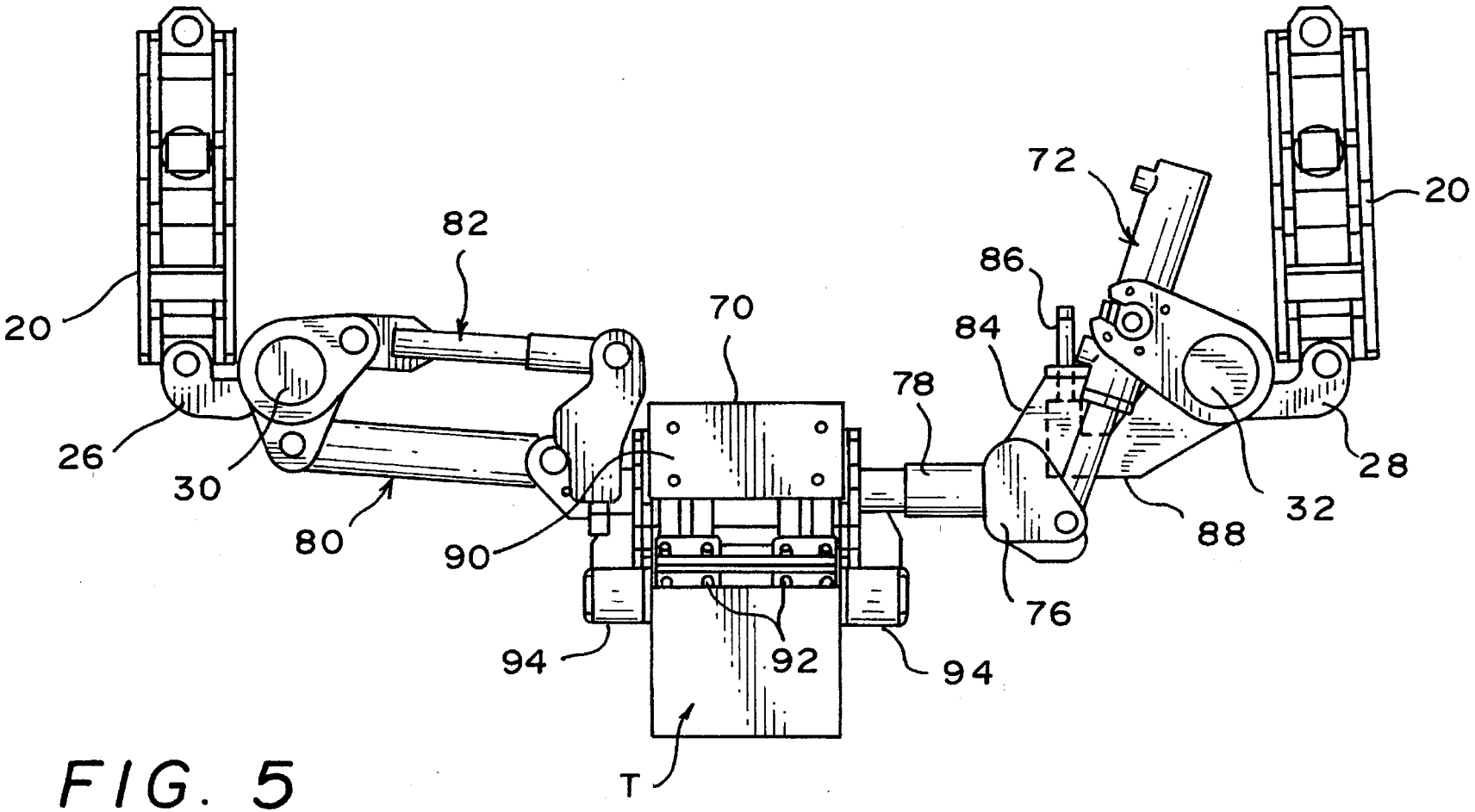
FIG. 5 is a side view of portions of the apparatus.

Turning to FIGS. 2, 3, and 5 in conjunction, a tie guide 70 is movable up and down by tie guide lifter actuators 72 which have their barrel ends pivotably attached to plates 74. The plates 74 are fixed to member 32 of apparatus frame 18. The rod ends of actuators 72 are pivotably attached to member 76 connected to the remainder of tie guide 70 by members 78.

As best shown in FIG. 5, tie guide 70 is also attached to the member 30 of apparatus frame 18 by four bar linkages made of links 80 and adjustable links 82 (only one of each visible in FIG. 5), which maintain the orientation of tie guide 70 when it is moved up and down by actuators 72. Plates 84 are fixed to member 76 to move up and down with tie guide 70. Bolts 86 are mounted thereon to serve as an adjustable stop by hitting a portion of plate 88 fixed to member 32 when the tie guide 70 is dropped to a lower guiding position relative to the apparatus frame 18.

A central portion 90 of tie guide 70 includes a series of rollers 92 free to rotate about axes perpendicular to the lengthwise direction of tie T and front and back side plates 94 at each side, the side plates 94 having wide mouths and being tapered inward to direct the tie T into the space therebetween without binding. The space between side plates 94, which serve as side members, is considered as a tie channel extending transversely to a rail direction and into which a tie is channeled when it is inserted, as clearly shown in FIG. 5. Rollers 92 are mounted to chains 92C (see visible one in FIG. 3) which are unpowered, but help minimize friction between the bottom of tie guide 70 and the top of a tie T being inserted (see FIG. 5). As with the other portions of apparatus 18, the tie guide 70 is symmetric about a central axis (not shown) extending lengthwise between and parallel to rails R.

Figure 6:
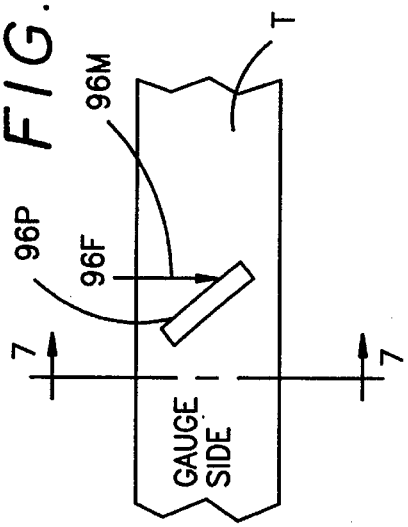
FIG. 6 is a top view of a tie and a portion of a sweeper of the apparatus.
Figure 7:
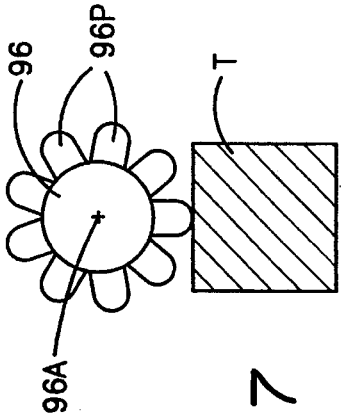
FIG. 7 is a simplified cross sectional view along lines 7—7 of FIG. 6.

With reference to FIGS. 3, 6, and 7 in conjunction, a hydraulic sweeper 96 on each side has nine sweep paddles 96P (shown schematically in FIG. 7, left out of FIG. 3 for ease of illustration) which turn about central axis 96A. They may follow a circular pattern, an oval pattern with major axis horizontal, or, as shown, an oval pattern with major axis being vertical. In any case, the paddles 96P sweep ballast or other debris off new ties as they are inserted. The top view of FIG. 6 shows that the paddle 96P sweeping over the top of tie T in direction 96M is inclined to push debris leftwardly, off the tie and towards the unshown central axis between the two rails R. By having the sweep elements or paddles 96P sweep towards the central axis, debris is kept away from the rails R. The paddles 96P are ¼ inch steel mounted to parallel hydraulically powered chain drives 98 (FIG. 3). The chain drives 98 are supported by the members 100 which are part of tie guide 70.

The operation of the apparatus 18 will now be described. The vehicle 10 moves to the tie to be removed. During this movement, the hydraulic valves (not shown) controlling the apparatus frame lifter actuators 22 are in the floating mode such that apparatus frame 18 can freely move up or down as it rolls on rails R. When the tie guide 70 and plate holders 38 are over a tie to be removed, actuators 22 cause frame 18 to press downwardly. At the same time, plate holder actuators 42 move plate holders 38 from their upper positions to their lower positions. Jaw actuators 67 are then retracted to bring four grip elements or jaws 68 against each of the two tie plates corresponding to the tie being replaced. The springs 60 insure that, when beginning to grip a tie plate, each pair of mechanical grip elements will automatically center about the tie plate prior to securely gripping the tie plate and without moving the tie plate. In other words, the springs 60 cause jaws to float at opposite ends of shaft 69 and tend to equalize force on both opposed jaws 68. Frame lifters 22 are returned to the floating mode and reduced pressure is supplied to tend to lift plate holders 38 which now hold the plates P. When the rail is lifted using the process described in the incorporated by reference patents, the plate holders 38 hold the tie plates P against the bottoms of the rails R. Floating of the frame lifter actuators 22 at this time avoids hindering removal of the old tie.

Before the new tie is inserted, pressure is applied to guide lifters or actuators 72 which lowers tie guide 70 into its lower or tie guiding position. Tie guide 70 is moved down to the position determined by the bolts 86. Tie sweepers 96 are activated to sweep and prevent ballast from getting between the tie T and tie plates P. The new tie T is now inserted.

After the new tie is inserted, plate hold or clamp actuators 67 are extended such the jaws 68 release the plates P. Before that happens, the plates P are automatically centered relative to tie guide 70 by operation of springs 60. Therefore, they will be centered relative to the central axis of the new tie being inserted and best positioned for attachment to the new tie. After jaws 68 release the plates, plate holder lift actuators 42 are extended to lift plate holders 38 and tie guide lift actuators 72 are retracted to lift tie guide 70 such that the vehicle may move to the next tie to be replaced.

When the vehicle is to travel long distances without replacing ties, actuators 22 are extended to lift the frame 18 relative to the vehicle frame 10M.

When moving between ties to be replaced, an operator may manually control the position of the vehicle. Alternately, a sensing system (not shown) may index or move the vehicle between ties. Such a sensing system is shown and described in U.S. Patent application of Newman et. al, Ser. No. 08/265,834, filed on Jun. 27, 1994, assigned to the assignee of the present application, and hereby incorporated by reference.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. An apparatus for aiding in tie replacement operations comprising:

a frame; and first and second side clamp assemblies supported by said frame, each of said first and second clamp assemblies having a pair of opposing field side mechanical grip elements and a pair of opposing gauge side mechanical grip elements, said pairs of field side and gauge side mechanical grip elements operable to grip tie plates when ties thereunder are removed and replaced; and wherein said pairs of field side and gauge side mechanical grip elements are self-centering such that, when beginning to grip a tie plate, each pair of mechanical grip elements will automatically center about the tie plate prior to securely gripping the tie plate and without moving the tie plate.

2. The apparatus of claim 1 wherein said first and second side clamp assemblies further include respective corresponding first and second grip hydraulic cylinders, each pair of mechanical grip elements being attached for movement with opposing rod and cylinder ends of one of the first and second hydraulic cylinders.

3. The apparatus of claim 2 wherein said first and second clamp assemblies further include at least one spring corresponding to each hydraulic cylinder and operably connected to corresponding mechanical grip elements for self-centering thereof.

4. The apparatus of claim 2 wherein said first and second clamp assemblies further include two springs corresponding to each hydraulic cylinder and operably connected to said corresponding mechanical grip elements for self-centering thereof.

5. An apparatus for aiding in tie replacement operations comprising:

a frame; and first and second side clamp assemblies supported by said frame, each of said first and second clamp assemblies having a pair of opposing field side mechanical grip elements and a pair of opposing gauge side mechanical grip elements, said pairs of field side and gauge side mechanical grip elements operable to grip tie plates when ties thereunder are removed and replaced;

wherein said first and second side clamp assemblies further include respective corresponding first and second grip hydraulic cylinders, each pair of mechanical grip elements being mounted for movement in a straight line parallel to an extension/retraction direction of the corresponding one of the first and second hydraulic cylinders; and further comprising a tie guide supported by said frame, said tie guide having a plurality of rollers on an underside thereof, said rollers operable to minimize friction between said tie guide and a new tie being inserted under said tie guide.

6. An apparatus for aiding in tie replacement operations comprising:

an apparatus frame with at least a first frame lifter connected to said apparatus frame for moving said apparatus frame between upper and lower frame positions relative to a vehicle main frame; and a first side clamp assembly supported by said apparatus frame and having mechanical grip elements operable to grip tie plates when ties thereunder are removed replaced; and wherein said mechanical grip elements include a pair of self-centering mechanical grip elements such that, when beginning to grip a tie plate, each pair of mechanical grip elements will automatically center about the tie plate prior to securely gripping the tie plate and without moving the tie plate.

7. The apparatus of claim 6 wherein said first side clamp assembly further includes at least one spring operably connected to self-center said pair of self-centering mechanical grip elements.

8. An apparatus for aiding in tie replacement operations comprising:

an apparatus frame with at least a first frame lifter connected to said apparatus frame for moving said apparatus frame between upper and lower frame positions relative to a vehicle main frame; and a first side clamp assembly supported by said apparatus frame and having mechanical grip elements operable to grip tie plates when ties thereunder are removed and replaced; wherein said mechanical grip elements are mounted to move in a straight line when moving to grip tie plates;

and wherein said mechanical grip elements are pairs of self-centering field side and gauge side mechanical grip elements such that, when beginning to grip a tie plate, each pair of field side and gauge side mechanical grip elements will automatically center about the tie plate prior to securely gripping the tie plate and without moving the tie plate.

9. An apparatus for aiding in tie replacement operations comprising:

an apparatus frame with at least a first frame lifter connected to said apparatus frame for moving said apparatus frame between upper and lower frame positions relative to a vehicle main frame; and a first side clamp assembly supported by said apparatus frame and having mechanical grip elements operable to grip tie plates when ties thereunder are removed and replaced; wherein said mechanical grip elements are mounted to move in a straight line when moving to grip tie plates; and further comprising a tie guide supported by said apparatus frame, said tie guide having a plurality of rollers on an underside thereof, said rollers operable to minimize friction between said tie guide and a new tie being inserted under said tie guide.

10. The apparatus of claim 9 further comprising a first sweeper supported by said apparatus frame and positioned to sweep debris off tops of ties being inserted.

11. An apparatus for aiding in tie replacement operations comprising:

an apparatus frame with at least a first frame lifter connected to said apparatus frame for moving said apparatus frame between upper and lower frame positions relative to a vehicle main frame;

a tie guide supported by said apparatus frame, said tie guide having side members defining a tie channel extending transversely to a rail direction, the tie channel being zone in which an inserted tie is channeled;

a first side tie plate holder vertically movable relative to said tie guide, supported by said apparatus frame and operable to grip tie plates when ties thereunder are removed and replaced; and a first sweeper supported by said apparatus frame and positioned to sweep debris off tops of ties being inserted.

12. The apparatus of claim 11 further comprising a tie guide lifter operably connecting said tie guide to said apparatus frame for causing relative vertical movement therebetween and a second sweeper supported by said apparatus frame and positioned to sweep debris off tops of ties being inserted.

13. The apparatus of claim 11 wherein said tie plate holder comprises a first side clamp assembly supported by said apparatus frame and having mechanical grip elements operable to grip tie plates when ties thereunder are removed and replaced.

* * * * *